United States Patent [19]

Thompson et al.

[11] Patent Number: 4,961,579

[45] Date of Patent: Oct. 9, 1990

[54] ELECTRONIC PUZZLE GAME

[75] Inventors: Barbara J. Thompson; Russell D. Bingham; William Holmes, Jr., all of Knox County, Tenn.

[73] Assignee: Tutor Toys, Inc., Knoxville, Tenn.

[21] Appl. No.: 300,965

[22] Filed: Jan. 23, 1989

[51] Int. Cl.[5] ..... A63F 9/00; G09B 7/02

[52] U.S. Cl. ..... 273/153 R; 223/1 E; 434/169; 434/335

[58] Field of Search ..... 273/1 E, 237, 153 R; 434/167, 169, 322, 335

[56] References Cited

U.S. PATENT DOCUMENTS

| | | | |
|---|---|---|---|
| 3,052,041 | 9/1962 | Luxon et al. | 434/169 |
| 4,308,017 | 12/1981 | Laughon et al. | 434/169 |
| 4,369,973 | 1/1983 | D'Aurora et al. | 273/153 R |
| 4,403,965 | 9/1983 | Hawkins | 434/327 |
| 4,421,487 | 12/1983 | Laughon et al. | 434/169 |
| 4,438,932 | 3/1984 | Finkel | 273/237 |
| 4,457,719 | 7/1984 | Dittakavi et al. | 434/159 |
| 4,492,582 | 1/1985 | Chang et al. | 434/169 |
| 4,505,682 | 3/1985 | Thompson | 434/335 |
| 4,519,606 | 5/1985 | Lussiez | 434/167 |
| 4,809,979 | 3/1989 | Skowronski et al. | 273/153 R |

*Primary Examiner*—Edward M. Coven
*Assistant Examiner*—Jessica J. Harrison
*Attorney, Agent, or Firm*—Pitts and Brittian

[57] ABSTRACT

An electronic puzzle game device for players/students. The device includes a memory for storing code corresponding to a plurality of sets of alpha-numeric symbols, each set comprising a puzzle. A display is provided for visibly indicating a selected puzzle. In the preferred embodiment, a player can vary the degree of difficulty of the displayed puzzle which generally includes a topic together with a selected number of letter cues. A player or student will preferably list words which start with the randomly selected letter cues and correspond to the displayed topic. A timer serves to determine the length of the time period a player has to solve the puzzle. In one embodiment, audible signals, including the counting down of the timer and the ending of the timer cycle are provided.

18 Claims, 4 Drawing Sheets

ELECTRONIC PUZZLE GAME

TECHNICAL FIELD

This invention relates to an electronic game device and more particularly concerns a device for generating and displaying alphanumeric puzzles to be solved by players during limited periods of time.

BACKGROUND ART

Electronic learning aid products designed to deal with specific educational problems such as spelling, math, reading or the like have heretofor been known. Certain of these products have the capability of communicating with the student through synthesized speech. Prior art generally related to the field of such educational products as described in the following U.S. Pat. Nos.: 4,505,682; 4,403,965; 4,457,719; and 4,327,375.

As will be recognized, numerous board games have been heretofore produced for presenting selected alphanumeric problems to be solved. However, to date, no known dedicated electronic games have been directed towards the specific problem associated with presenting alphanumeric puzzles to a player for solution within a limited period of time.

Accordingly, it is an object of the present invention to provide an electronic puzzle game which is lightweight, portable and simple to use with little maintenance.

It is another object of the present invention to provide such an electronic puzzle game which can aid a player or student in increasing in knowledge of vocabulary and words related to a wide variety of subjects or categories.

It is a further object of the present invention to provide such an electronic puzzle game which presents material to be learned in a game-like format in order to increase a player or student's enjoyment during the learning experience.

It is another object of the present invention provide an electronic puzzle game that will generate and display each one of a series of topics or categories, in a first display location, and a selected number of random letters in a second display location, proximate said first display location, as a puzzle to be solved by one or more student's guessing and writing down words that begin with each of the letters corresponding the topic/category.

It is an object of the present invention to provide an electronic puzzle game that will also generate and display a "wild card" indication, as well as a variety of other titles and device conditions, in either or both display locations.

It is yet another object of the present invention to provide in one embodiment an electronic puzzle game having an integral timer with audible and/or visual indications, the timer being the method of determining the period within which the puzzle is to be solved, and thus also helping to determine the difficulty level of the puzzle, the difficulty level being fully determined by a combination of the particular categories/topics preassigned and stored for each level, and the amount of time pre-allotted for the solution of the puzzle at that level.

It is a still further object of the present invention to provide an electronic puzzle game having a means of accepting signals input by the student relating the starting and stopping of each round of play, the choice of levels of difficulty, and power on and off.

It is still another object of the present invention to provide an electronic puzzle game having a plurality of topics from which to choose through the use of internal memory and/or external, plug-in expansion modules, each containing multiple different categories.

DISCLOSURE OF THE INVENTION

Other objects and advantages will be accomplished by the present invention which provides an electronic puzzle game device which assists in developing and/or enhancing a student's vocabulary and/or comprehension of abstract concepts by providing exercises in recall and application of words associated with specific subjects or categories. The puzzle game device includes a memory for storing code corresponding to a plurality of sets of alphanumeric symbols, each set comprising a puzzle. A randomly selected puzzle is displayed for viewing by a player or student. The player can manually select or vary the degree of difficulty of the displayed puzzles which are chosen from a plurality of categories. An integral timer is provided to determine the length of time a player(s) has to solve a displayed puzzle. In the preferred embodiment, an integral timer is started and begins counting down upon the appearance of a puzzle on the display. An audible tone is preferably generated after a selected time interval.

BEST MODE FOR CARRYING OUT THE INVENTION

Figure 1:
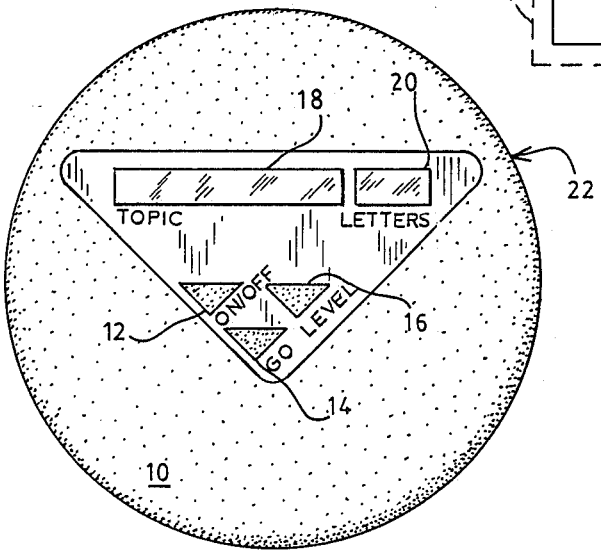
FIG. 1 is a pictorial view of the key pad and display unit of an electronic device 10 constructed in accordance with various features of the present invention and comprising input means 12, 14, 16 and display means 18, 20, in a housing 22.

Referring now to the drawings an electronic puzzle device constructed in accordance with various features of the present invention is illustrated generally at 10 in FIG. 1. This device is particularly designed to teach vocabulary and word recall, and will be described first in terms of its components and then in connection with its operational modes.

The electronic puzzle game 10 of the present invention is comprised of a housing 22, which carries input keys 12, 14, 16, display means 18, 20, an external power jack, a battery compartment, and a printed circuit board containing electronic components, the latter items without reference numerals not being illustrated. User input into the device 10 in the preferred embodiment is accomplished by means of switches, also called keys, which include in the preferred embodiment the ON/-OFF key 12, the GO key 14, and the LEVEL key 16.

One output from the device is in the form of visible displays being a display of up to 13 characters in length in the preferred embodiment in a first display window 18, called TOPIC, and and a selected number of letters (three letters in the illustrated embodiment) in a second display window 20, proximate said first display window, and called LETTERS.

Figure 3:
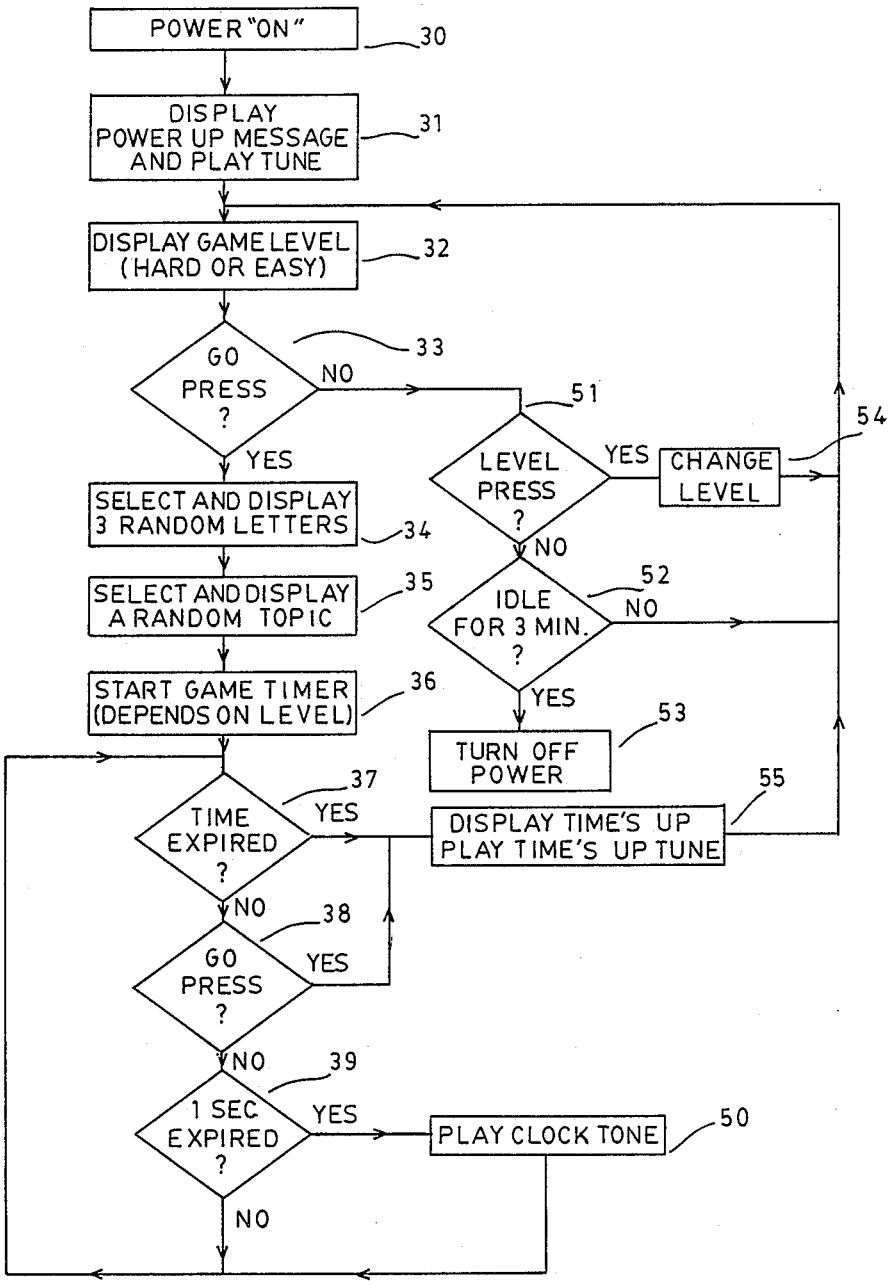
FIG. 3 is a functional flow-chart of an electronic device of the present invention.

An optional output from the device 10 is in the form of audible tones, indicative of various states or conditions of the device as may be more plainly seen in the Flow Charge of FIG. 3.

The electronic puzzle game of the present invention is prepared for energizing by insertion of batteries into the internal compartment provided, or by the application of external voltage in a conventional manner.

In a preferred embodiment, the electronic puzzle game having been prepared for use by having external voltage applied or batteries inserted, is energized by having the ON/OFF key pressed. As indicated at 30 in the flow diagram of FIG. 3, this applies energizing voltage to the electronic circuit components, thereby causing a POWER UP message to be automatically displayed in the TOPIC window 18 and an opening tune (when the audible output option is chosen) in the preferred embodiment to be generated through the audio system as indicated at 31. Immediately subsequent to this message, the game level message ("HARD" or "EASY") will replace the display in the TOPIC window 18, as at 32, as at 33. The student/player can press the GO key 12 to initiate play at the displayed level, or the LEVEL key 16 can be pressed as indicated at 51 one or more times until the desired level of difficulty is reached. As indicated at 54, the level change will eventually be displayed as shown at 32.

If no key is pressed for a selected period of time such as three minutes in one embodiment, the automatic power down circuit will remove the energizing voltage from a majority of the circuit components, 52 and 53.

When the GO key 12 is pressed, a category is displayed in said first display window 18 and three letters (in the preferred embodiment) are displayed in said second display window 20, as depicted at 34 and 35. Immediately thereupon, the round timer will be started as shown at 36 in the flow diagram of FIG. 3 and a tone generated indicating the passage of a selected interval of time or for every second as shown at 39 and 50. The object of the exercise is to have the student(s)/player(s) name and/or write a selected number (three for example) of words that begin with each of the three letters displayed, commensurate with the topic displayed.

The time allotted to play each round is dependent upon the level of difficulty selected 36. When this time elapses as shown at 37 in FIG. 3, the "TIME'S UP" message replaces the topic previously displayed and the "TIME'S UP" tune is generated as is shown at 55.

If a student/player achieves the purpose of the exercise and writes a number of words on a separate sheet of paper, points are awarded for the number of words written during a time period determined by the timer. The points are tallied for a round and the GO key is pressed to begin a new round. It will be recognized that the timer can be separate from the game, i.e., not made an integral part of the game in one embodiment.

In this manner, play may continue indefinitely until the ON/OFF key 12 is pressed the second time or until a selected time of three minutes in the described embodiment, have gone by without a key press. Either of these occurrences will remove power from the circuit as shown at 53 in a conventional manner.

Figure 5:
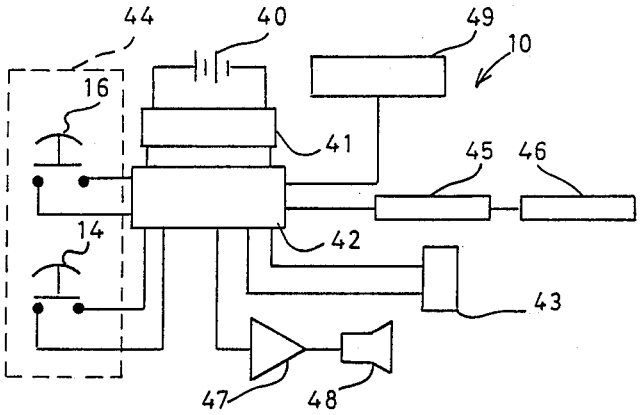
FIG. 5 is a block diagram of an electronic puzzle game constructed in accordance with various features of the present invention.
Figure 4:
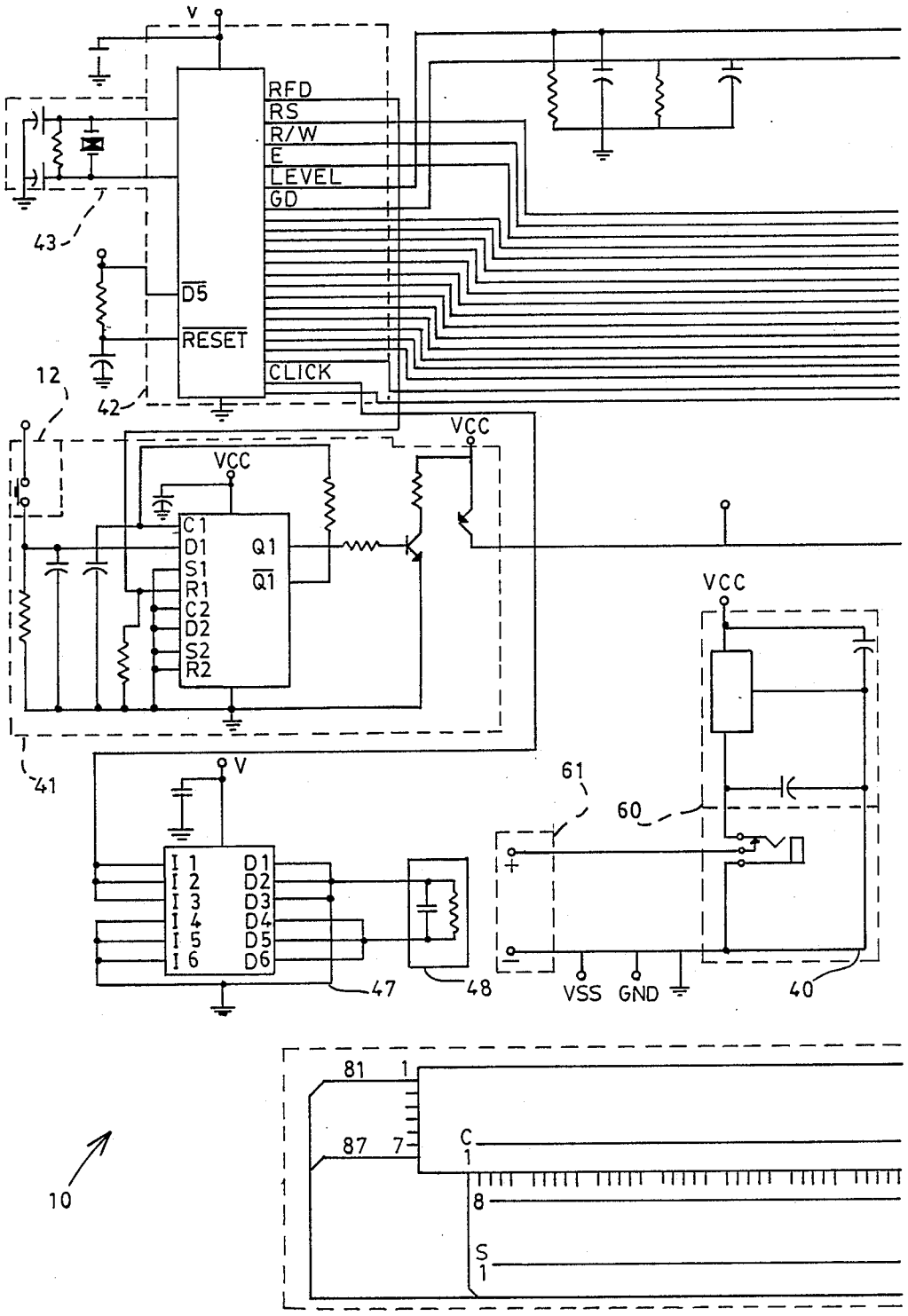
FIG. 4 is a schematic drawing of the present invention.
Figure 4:
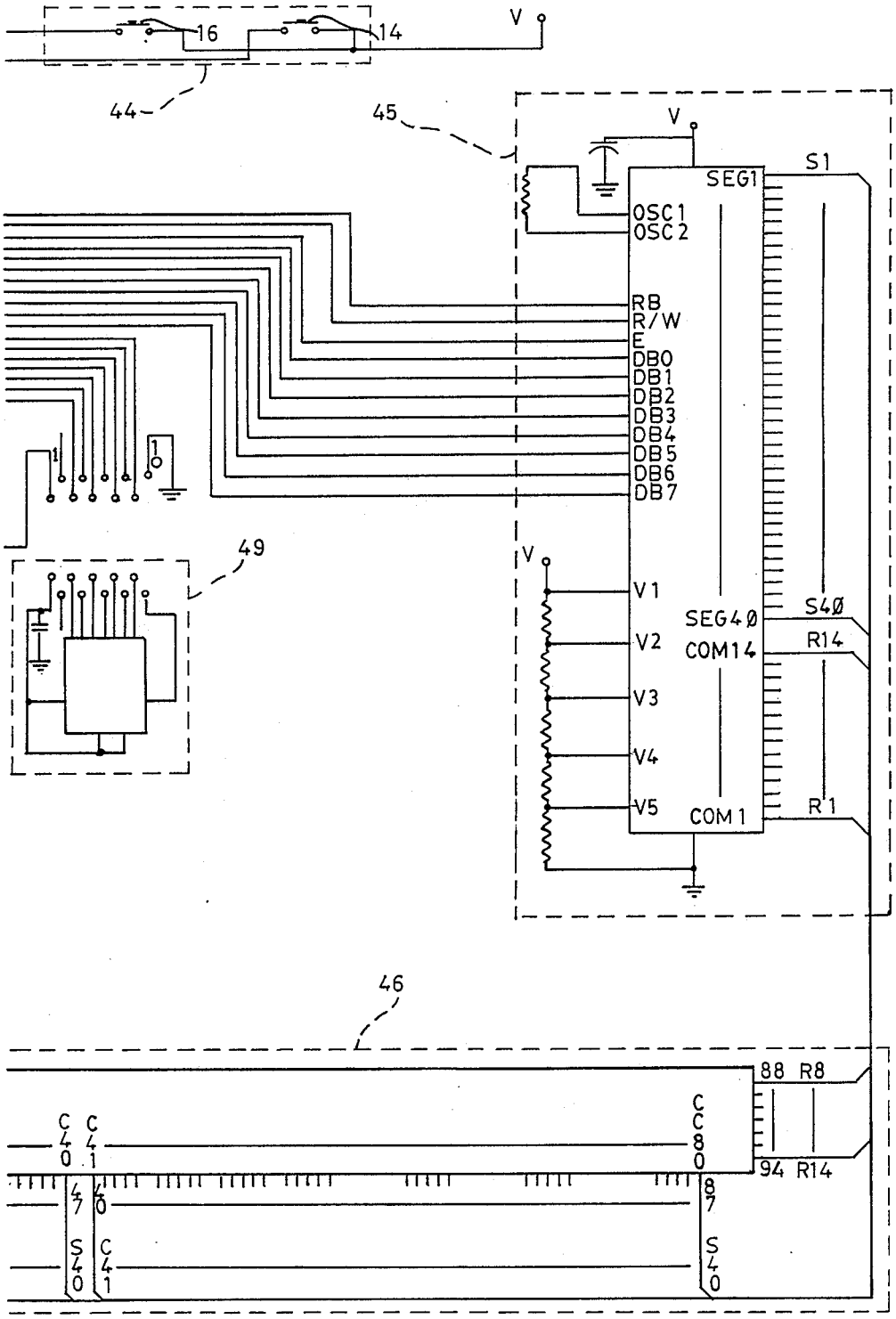

A block diagram of the majority of the circuit of the circuit is shown in FIG. 5, and a schematic together with components of the block diagram depicted is shown in FIG. 4.

Referring now to FIGS. 4 and 5, when either external or battery voltage is applied to VI of the LM78L05 Regulator IC 60, a regulated five volts will be present at the points labeled VCC but nowhere else until ON/-OFF SWITCH 12 is pressed. When ON switch 12 is pressed, VCC is applied to the D1 input of the 4013 IC in the Auto Power Down Circuit 41. If the Q1 output comes up as a logic one (same value as VCC), transistor Q2 turns on and turns transistor Q1 on, applying VCC/APD throughout the circuit. If the Q1 output of the 4013 comes up as a logic zero, output Q1 NOT must be a logic one. Q1 NOT is tied to the C1 input which operates to clock the high (logic one) at the D1 input through to change Q1 to a high and Q1 NOT to a low state.

Figure 2:
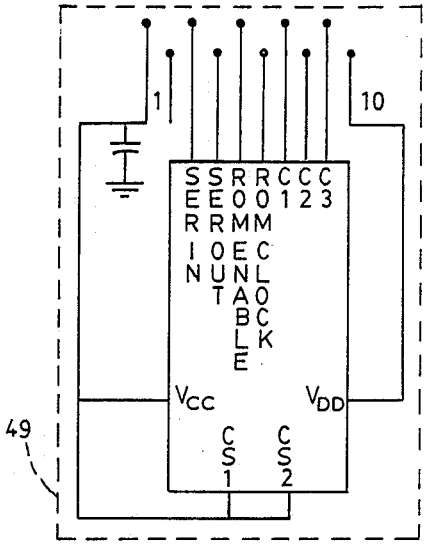
FIG. 2 is a schematic drawing of a plug-in expansion module.

When VCC/APD is applied to the microprocessor IC, the microprocessor resets and begins executing its instruction set from address 000CH. After the initial displays as previously described, the microprocessor 42 awaits input instructions. When the GO key 14 is pressed, a topic and set of random letter cues are extracted from the internal memory of the microprocessor 42 or from the expansion module 49 (see FIGS. 2 and 5) if a module is present and transmitted to the LCD Controller or Display Driver 45 and subsequently to the Display 46. Auditory signals are sent from the microprocessor or pin 28. In the embodiment shown, a hex inverter type 4049 IC indicated at 47 is used as a Buzzer Drier to drive the Buzzer 48. In yet another embodiment, 47 may be an audio amplifier and drive a speaker 48 as shown in FIG. 5.

From the foregoing detailed description, it will be recognized by those skilled in the art that an electric game of intellectual challenge has been provided. The game displays random topics from such subjects as foods, animals, songs, candy, insects, authors, plants, and movie stars. These topics are stored in the built-in memory of the microprocessor 42 and/or in a plug-in expansion module 49 which can be used for additional games. Letter cues are randomly generated and displayed at 22 in the preferred embodiment. The player/-student then thinks of words that start with the letters shown and match the topic displayed. It will be recognized that other games could also be played as by unscrambling letters to form words. The level of difficulty can be varied to match the skills of the player/student.

While a preferred embodiment has been shown and described, it will be understood that there is no intent to limit the invention to such disclosure, but rather it is intended to cover all modifications and alternate constructions falling within the spirit and scope of the invention as defined in the appended claims.

We claim:

1. An electronic puzzle game device for increasing knowledge of a user by causing said user to develop responses to a puzzle topic, comprising:

microprocessor means including memory means for storing codes corresponding to a plurality of random sets of alphanumeric characters, each set comprising a puzzle topic together with a random cue to prompt said user relative to said puzzle topic;

display means connected to said microprocessor means for displaying a randomly selected puzzle topic to said user from said memory means;

further display means connected to said microprocessor means for displaying a plurality of randomly selected alphanumeric characters from said memory means as said cue to said puzzle topic; and user input means connected with said microprocessor means for initiating a game and for changing said displayed puzzle topic whereby said user responds to said displayed random puzzle topic using said displayed random cue.

2. The electronic puzzle game device of claim 1 further comprising timing means initiated by said user input means for determining a selected time period allotted said user to respond to said puzzle topic.

3. The electronic puzzle game device of claim 2 further including audible means for audibly indicating passage of time and expiration of said time period allotted for said response to each said puzzle topic.

4. An electronic puzzle game device for increasing knowledge of vocabulary and words of a user, comprising:

microprocessor means including memory means for storing codes corresponding to a plurality of sets of individual and sets of alphanumeric letters, each set comprising a word puzzle topic together with a random cue to prompt said user relative to said puzzle topic;

display means connected to said microprocessor means for displaying a randomly selected word puzzle topic from said memory means to said user;

further display means connected to said microprocessor means for displaying a plurality of randomly selected of said individual alphabetical letters as said cue to said word puzzle topic from said memory means to said user;

user input means to said microprocessor means for initiating a game, for changing said word puzzle topic displayed and for varying the degree of difficulty of said displayed word puzzle topic; and timing means initiated by said user input means for determining a selected time period allotted said user to respond to said word puzzle topic.

5. The electronic puzzle game device of claim 4 further including audible means for audibly indicating passage of time and expiration of said time period allotted for said response to each said word puzzle topic.

6. The electronic puzzle game device of claim 4 wherein said memory means includes pluggably interchangeable external expansion modules and a built-in memory, said expansion modules and said built-in memory each containing selected individual and sets of alphabetic letters for use in said display means and said further display means.

7. The electronic puzzle game device of claim 2 wherein said user input means includes means for manually terminating a round of play.

8. A portable electronic puzzle game device useful for increasing a user's knowledge of vocabulary and words related to various word topics by causing said user to generate words related to a selected word topic, which comprises:

user input means for initiating operation of said device;

display means for visually depicting for said user a random one of said various word topics;

further display means for visually depicting for said user a plurality of random alphabetic letters as cues for responses to said displayed word topic; and microprocessor means, including memory means, connected to said user input means and to said display means and further display means for generating a signal to said display means corresponding to said one of said random word topics and for generating a signal to said further display means corresponding to said plurality of random alphabetical letters, said random word topics and said random alphabetic letters being stored in said memory means, whereby said user generates word responses to said displayed random word topic using said displayed random alphabetic letters as cues.

9. The device of claim 8 further comprising further user input means for selecting a level of difficulty for said word topics.

10. The device of claim 9 further comprising enclosure means for said input means, said further input means, said display and further display means, and said microprocessor means.

11. The device of claim 10 wherein said display means is a display mounted in a face of said enclosure means for providing to said user a visualization of a selected one of said random word topics and said level of difficulty, said further display means is a display mounted in said face of said enclosure means provided to said user a visualization of said random alphabetical letters, said user input means is a keyboard mounted in said face of said enclosure providing for initiation of operation of said device by said user, and said further user input means is a keyboard mounted in said face of said enclosure providing for selection of said level of difficulty of said topic by said user.

12. The device of claim 8 further comprising a timing means initiated by said user input means for generating a signal after an elapse of a preselected time interval for said user to select words within said one random word topic by forming words using said random alphabetic letters.

13. The device of claim 12 wherein said timing means is within said microprocessor means.

14. The device of claim 13 whwerein said microprocessor means provides signals to an audible sound means for producing audible sounds corresponding to conditions of operations of said device.

15. The device of claim 14 whwerein said audible sound means generates an audible sound upon elapse of said preselected time interval.

16. The device of claim 8 further comprising interchangeable supplemental memory means for said microprocessor means for introducing supplemental random word topics and supplemental random alphabetic letters for display in said display means and said further display means, respectively.

17. A portable electronic puzzle game device, for use with a separate recording medium, useful for increasing a user's knowledge of vocabulary and words related to various word topics, comprising:

user input means for initiating operation of said device;

display means for visually depicting for said user a random one of said various word topics;

further display means for visually depicting a plurality of random alphabetic letters as cues for forming words to be selected by said user within said random one of said word topics and recorded on said separate recording medium;

microprocessor means, including memory means, connected to said user input means and to said display means and further display means for generating a signal to said display means corresponding to said one of said random word categories and for generating a signal to said further display means corresponding to said plurality of random alphabetical letters, said random word topics and said random alphabetic letters being stored in said memory means;

timing means actuated by said user input means for preselecting a time interval for said user to form said words from said alphabetical letters displayed in said further display means and record said words on said separate recording medium; and enclosure means for said input means, said further input means, said display and further display means, and said microprocessor means.

18. The device of claim 17 wherein said memory means includes a built-in memory means and pluggably interchangeable external expansion memory modules, said built-in memory means and said expansion memory modules each containing said individual and sets of alphabetical letters.

* * * * *